US006228014B1

(12) United States Patent
De Matteis et al.

(10) Patent No.: US 6,228,014 B1
(45) Date of Patent: May 8, 2001

(54) INTERFOLDING METHOD OF SHEET MATERIAL AND MACHINE FOR CARRYING OUT SUCH METHOD

(75) Inventors: Alessandro De Matteis, Lucca; Sergio Landucci, Ponte a Moriano, both of (IT)

(73) Assignee: M T C - Macchine Trasformazione Carta S.R.L., Porcari Lu (IT)

( * ) Notice: Subject to any disclaimer, the term of this patent is extended or adjusted under 35 U.S.C. 154(b) by 0 days.

(21) Appl. No.: 09/378,017

(22) Filed: Aug. 19, 1999

(30) Foreign Application Priority Data

Aug. 21, 1998 (EP) ..... 98830508

(51) Int. Cl.[7] ..... B31F 1/10

(52) U.S. Cl. ..... 493/424; 493/425; 493/426; 493/427; 493/429; 493/430; 493/433

(58) Field of Search ..... 493/424, 425, 493/426, 427, 428, 429, 430, 360, 433, 432, 440

(56) References Cited

U.S. PATENT DOCUMENTS 3,163,413 * 12/1964 Franke et al. ..... 270/73
3,229,974 * 1/1966 Banks ..... 270/73
4,070,014 * 1/1978 Takahashi ..... 270/39
4,778,441 * 10/1988 Couturier ..... 493/425
5,000,729 * 3/1991 Yamauchi ..... 493/359
5,310,398 * 5/1994 Yoneyama ..... 493/430
5,425,697 * 6/1995 Lanvin ..... 493/426

* cited by examiner

*Primary Examiner*—Stephen F. Gerrity
*Assistant Examiner*—Sam Tawfik
(74) *Attorney, Agent, or Firm*—Simpson, Simpson & Snyder, L.L.P.

(57) ABSTRACT

A machine (1) for interfolding sheet material (4*a*, 4*b*) starting from a web (3*a*, 3*b*) of paper and the like. A sequence of offset sheets (4*a*, 4*b*) is formed on folding rollers (7*a*, 7*b*) which are counter-rotating with respect to each other and have a plurality of circumferential grooves (15*a*, 15*b*), in which oscillating folding arms engage (20*a*, 20*b*) so as to form a stack (17) of interfolded sheets (4*a*, 4*b*). The folding arms (20*a*, 20*b*) have pivots (21) very close to the periphery of the folding rollers (7*a*, 7*b*), inside or outside of the grooves (15*a*, 15*b*). Moreover they can be operated by a crank mechanism that allows to the grooves (15*a*, 15*b*) to be shallow enough also in case of rollers (7*a*, 7*b*) of enlarged diameter. For the same reason, the folding arms (20*a*, 20*b*) can have a bent portion.

14 Claims, 5 Drawing Sheets

Fig. 2
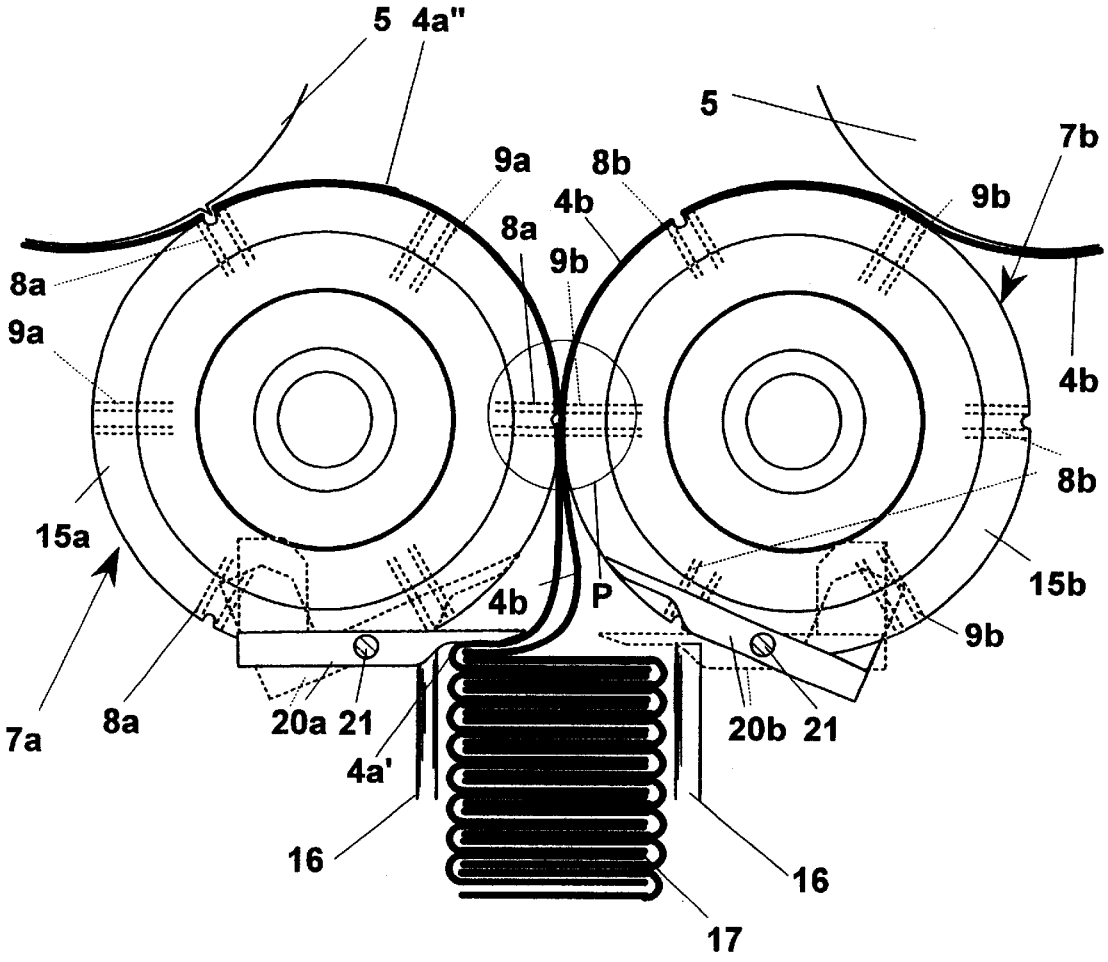
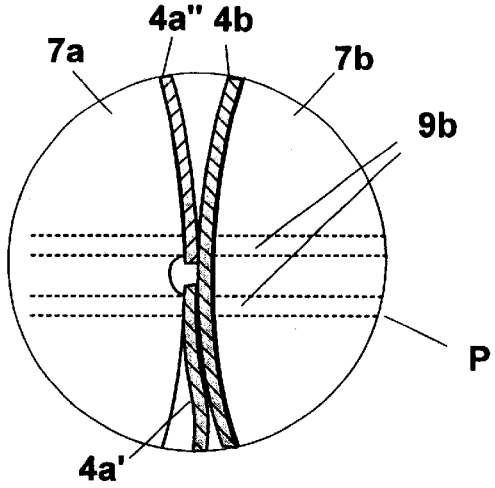
Fig. 3

Fig. 4
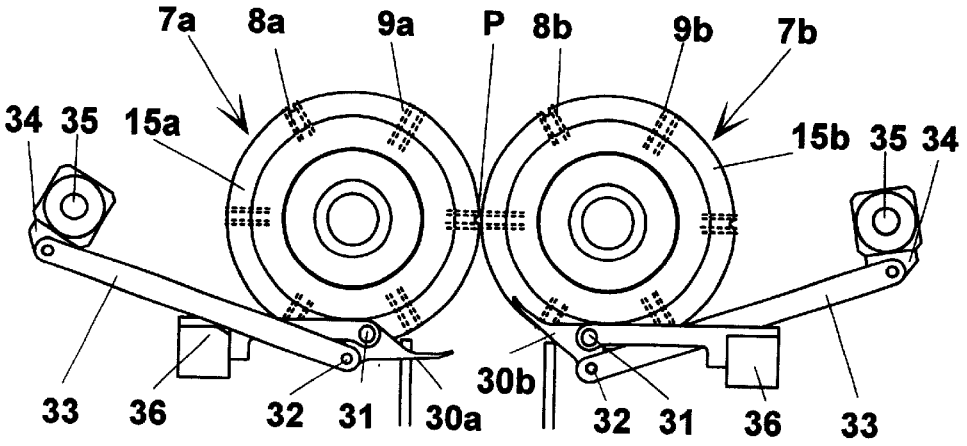
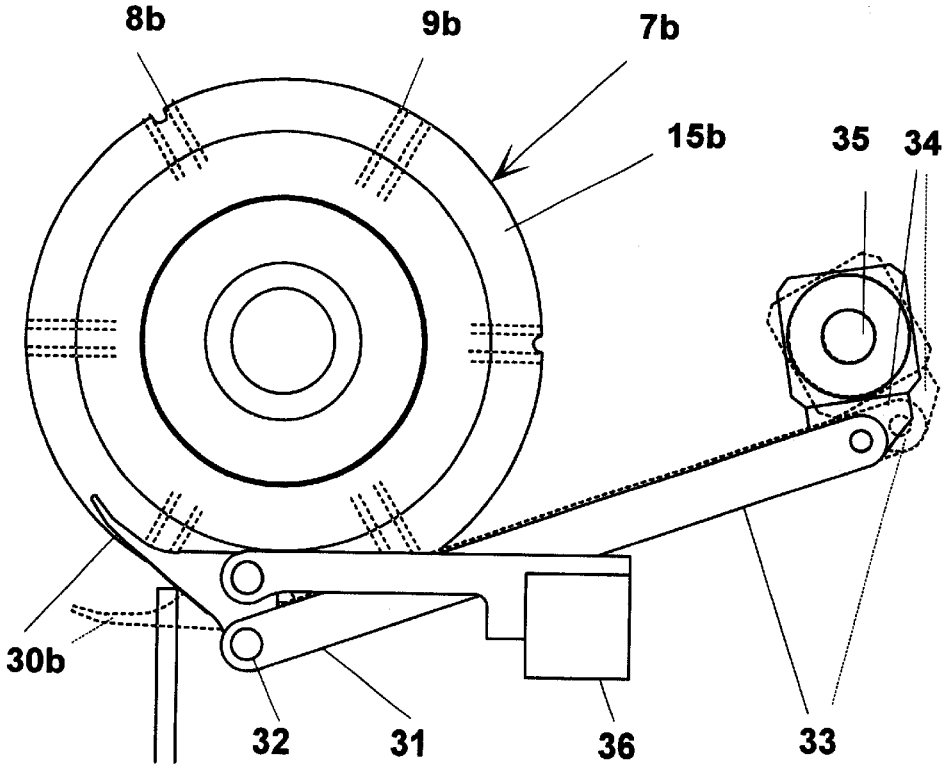
Fig. 5

Fig. 6
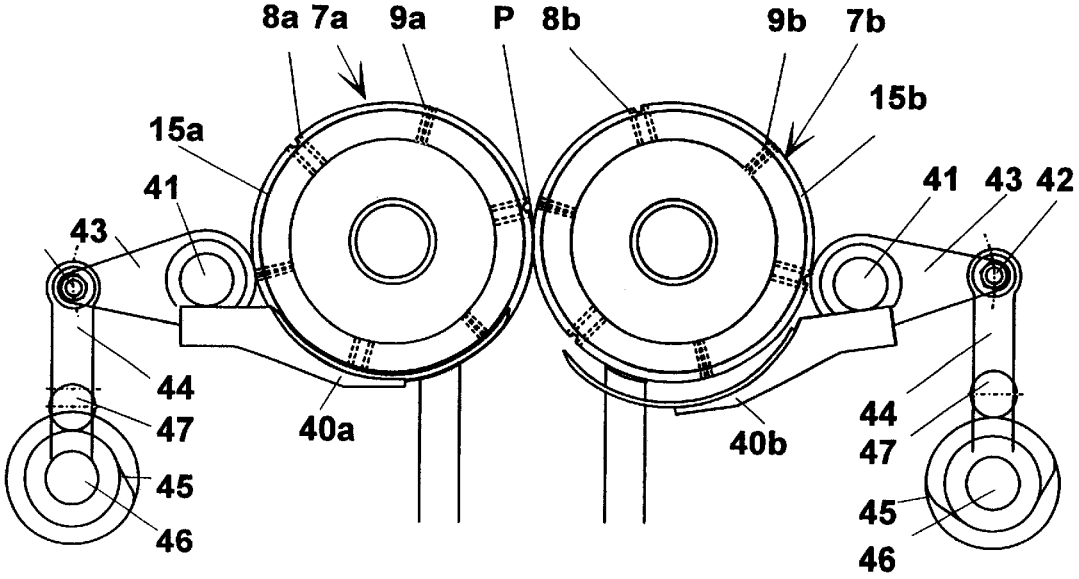
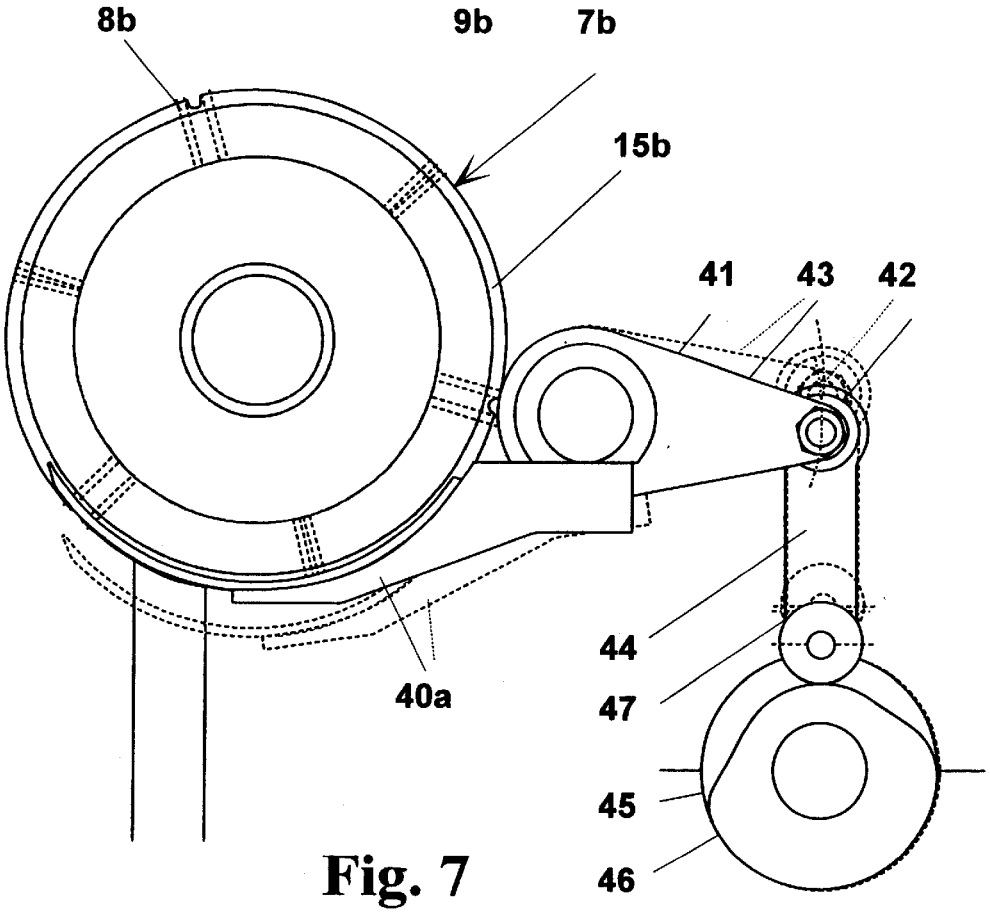
Fig. 7 prior art

INTERFOLDING METHOD OF SHEET MATERIAL AND MACHINE FOR CARRYING OUT SUCH METHOD

FIELD OF THE INVENTION

The present invention generally relates to paper converting machines and more precisely it relates to the production of interfolded stacks of paper sheets, for example paper wipers, toilet paper, napkins and the like.

In particular, it relates to a sheet interfolding method and to a machine used to carry out such method.

BACKGROUND OF THE INVENTION

Wipers, certain types of toilet paper, paper napkins and the like are packed in stacks of a fixed height. They are made starting from sheets of absorbent material, for example "tissue" paper, non-woven fabric, etc.

The production starts from a web having a large transversal width, from which sheets are obtained that are folded, stacked and divided into small stacks of a height equal to the final product. Each of these small stacks forms a log of a length equal to said transversal width. The logs, then, are cut off into many short stacks having the final size and packed.

In some cases, the sheets obtained from the web are folded separately from one another and then stacked already folded. In other cases, the sheets are interfolded, i.e., are folded into panels by overlapping at the same time a panel of a previous sheet with a panel of a following sheet. In this way, when pulling a sheet from the stack, at the moment of the use also a panel of the following sheet is pulled out, with consequent advantages for certain types of users. Among the possible interfolding ways the L, Z or W interfolded sheets are known having 2, 3 and 4 panels respectively.

For the production of interfolded stacks machines are known that use one or two webs of paper coming from a reel that are cut into sheets and then supplied offset with respect to one another on folding counter-rotating rollers.

More precisely, cutting rollers that engage with respective blades carry out the cutting step of the webs into sheets. In case of L or W interfolding the webs are cut and then supplied in order to form a sequence of sheets coming preferably from two different directions. Therefore, the sheets coming from both directions are supplied alternately to the folding rollers so that each sheet coming from a first direction overlaps a portion of the sheet coming from the second direction, and vice versa.

The sheets coming from both directions, in order to be overlapped in the above-described way, adhere to the respective folding rollers by means of a sucking step or by means of a mechanical gripping. Therefore, the downstream portion of each sheet leaves its folding roller at the point of contact between the two rollers, then adhering to the other folding roller, to which the upstream portion of the previous sheet adhered.

The method for Z interfolding is similar to what described, with the difference that the overlap between two consecutive sheets occurs just after the cutting step and a sequence of overlapping and offset sheets come to the folding rollers from only one direction.

The interfolded stacking step is accomplished by folding arms that have an oscillating motion about a pivot and that separate in turn from the respective roller the upstream portion of each sheet joined to the overlapped downstream portion of the following sheet. The folding arms are normally arranged in two rows and operate alternatively with the paired portions of sheets, which adhere to the first or to the second folding roller.

The folding rollers have a plurality of circumferential grooves, into which the ends of said folding arms go without blocking their rotation. At the passage of two overlapped portions of two consecutive sheets, that adhere to a roller and cover an end of the folding arms, the folding arms rotate so that their ends go out the grooves and push the two overlapped portions away from the roller, thus folding them onto previously interfolded sheets stacked below.

The folding rollers have a circumference that is normally two times the length of the sheets. Therefore, a sheet adds to the stack of interfolded sheets at each fourth of turn of the folding rollers.

In FIG. 8 an example is shown of folding rollers 57*a* and 57*b* according to the prior art having a circumference two times with respect to the length of the sheets. They comprise first sucking spots 58 that are active upstream of the point of contact P between the two rollers and second sucking spots 59 that are active downstream of the point of contact P between the two rollers. In such a point in turn the holes 58 of a roller substantially coincide with the holes 59 of the other roller. The overlap between two sheets 54*a* and 54*b* adhering to the two rollers occurs downstream of point P and folding arms 50*a* and 50*b* are provided that partially engage with grooves 55 and rotate about pivots 51 at a moment in which the separation from the rollers of partially overlapping sheets 54*a* and 54*b* can be carried out. The pivots 51 are distant from folding rollers 57*a* and 57*b*.

It is however felt the need of increasing the width of the webs to interfold, thus obtaining longer stacks to cut off. This causes, however, the unavoidable deflexion of the folding rollers, that already are weakened for the presence of the grooves and of the holding means. Deflected rollers cannot work and must be, therefore, stiffened, by increasing their cross section, thus increasing the number of sheets that can be interfolded at each turn. For example, folding rollers with circumference three times the length of the sheets allow a production of one interfolded sheet each sixth of turn, and folding rollers with circumference four times with respect to the length of the sheets allow a production of one interfolded sheet at each eighth of turn.

However, for the folding arms the increase of diameter has the consequence of more fatigue and a larger length. In particular, for causing the ends of the folding arms to go completely into the grooves and to be parallel to the interfolded stack of sheets being formed, and in order to assure a correct folding step, the pivot of rotation of the folding arms must be more distant from the folding rollers, the grooves must be deeper, and the folding arms are thus too long. Therefore, the present shapes and mechanisms of the folding arms are not appropriate for an increase of diameter.

SUMMARY OF THE INVENTION

It is therefore object of the present invention to provide an interfolding method in which the movement of the folding arms is such that it allows a correct interfolding step of the sheets also in case of folding rollers of larger diameter with respect to the prior art.

It is another object of the invention to provide a interfolding machine in which the folding arms comprise a mechanical transmission that causes a portion thereof to go parallel to the stack being formed also in case of folding rollers of larger diameter.

It is a further object of the invention to provide an interfolding machine in which the folding arms are shaped so that a larger portion thereof goes completely into the folding rollers also when the latter are of larger diameter with respect to the prior art.

These and other objects are achieved by the method for the production of a stack of interfolded sheets comprising the steps of:

feeding sheets in succession on folding rollers which comprise means for selectively holding the sheets on their surface so that a sequence of offset sheets is created;

alternate holding of the sheets on the folding rollers downstream of their point of contact in order to obtain an interfolded disposition;

folding and formation of an interfolded stack by means of folding arms that go into grooves provided in the folding rollers and push away alternately the partially overlapped portions of sheets in succession that adhere to said rollers onto a stack formed below.

The peculiarity of the method is that said folding step and formation of the interfolded stack provides the use of folding arms having pivot very close to the folding rollers.

In a first embodiment the folding arms rotate about a pivot inside the grooves. Advantageously, the folding arms have a bent portion encircling the rollers and allow to the pivot a position close to the periphery of the rollers. The pivot can be outside or inside such periphery. Moreover, owing to the bent shape, a portion of the folding arms can lay parallel to the stack being formed.

Advantageously, the movement of the folding arms is a composite movement obtained through two distinct points thereof in the same plane. In particular, a first of the two points can be chosen as pivot of rotation laying inside the external surface of the roller, that is inside the grooves, the second point rotating about the first point.

The folding arms can have curved shape so that they encircle the folding rollers inside the grooves, which can be shallow enough for giving to the folding rollers more flexional stiffness.

The interfolding machine used to carry out the method for the production of interfolded stacks, formed by a plurality of sheets comprises:

folding rollers counter-rotating with respect to each other supplied by sheets in succession and having circumferential grooves;

means for alternately holding the sheets which adhere to the folding rollers;

interfolding means suitable for the formation of a stack of sheets comprising folding arms oscillating about a pivot and going in and out said grooves of said rollers.

The folding arms have the peculiarity of being pivotally connected to a mechanical transmission of rotation about a pivot very close to the periphery of the folding rollers.

Advantageously, the folding arms have a bent portion, so that they encircle a portion of said rollers and allow that they have shallower grooves.

The mechanical transmission operating the folding arms preferably comprises:

a pivot of rotation to which said folding arms are pivotally connected in a first point;

a connecting rod hinged to the folding arms in a second point, an oscillating crank hinged to the connecting rod.

The pivot is preferably arranged on a fixed support, which keeps it inside the grooves of the rollers.

In a different embodiment the folding arms are preferably operated by a mechanical transmission comprising:

a pivot belonging to a connecting lever integral to the folding arms;

a rocking lever hinged to the connecting lever;

cam means that engage with a pin protruding from the rocking lever whereby the rocking lever carries out an alternating motion that causes said connecting lever and said folding arms to oscillate.

BRIEF DESCRIPTION OF THE DRAWINGS

Further characteristics and the advantages of the method and of the apparatus for interfolding sheet material according to the present invention, will be made clearer with the following description, but not limitative, of some of its embodiments, with reference to the attached drawings, wherein:

FIG. 2 shows a detailed view of the folding rollers of the machine of FIG. 1 comprising a first embodiment of the folding arms and of the mechanical transmission according to the present invention;

FIG. 3 shows an enlarged detailed view of the point of contact between the folding rollers of FIG. 2 and the folding arms when working;

FIGS. 4 and 5 show, respectively in cross sectional view and in partial cross sectional view, a second embodiment of the folding arms and of the mechanical transmission according to the present invention applied to the machine of FIG. 1;

FIGS. 6 and 7 show, respectively in cross sectional view and in partial cross sectional view, a third embodiment of the folding arms and of the mechanical transmission according to the present invention applied to the machine of FIG. 1;

DESCRIPTION OF THE PREFERRED EMBODIMENTS

Figure 1:
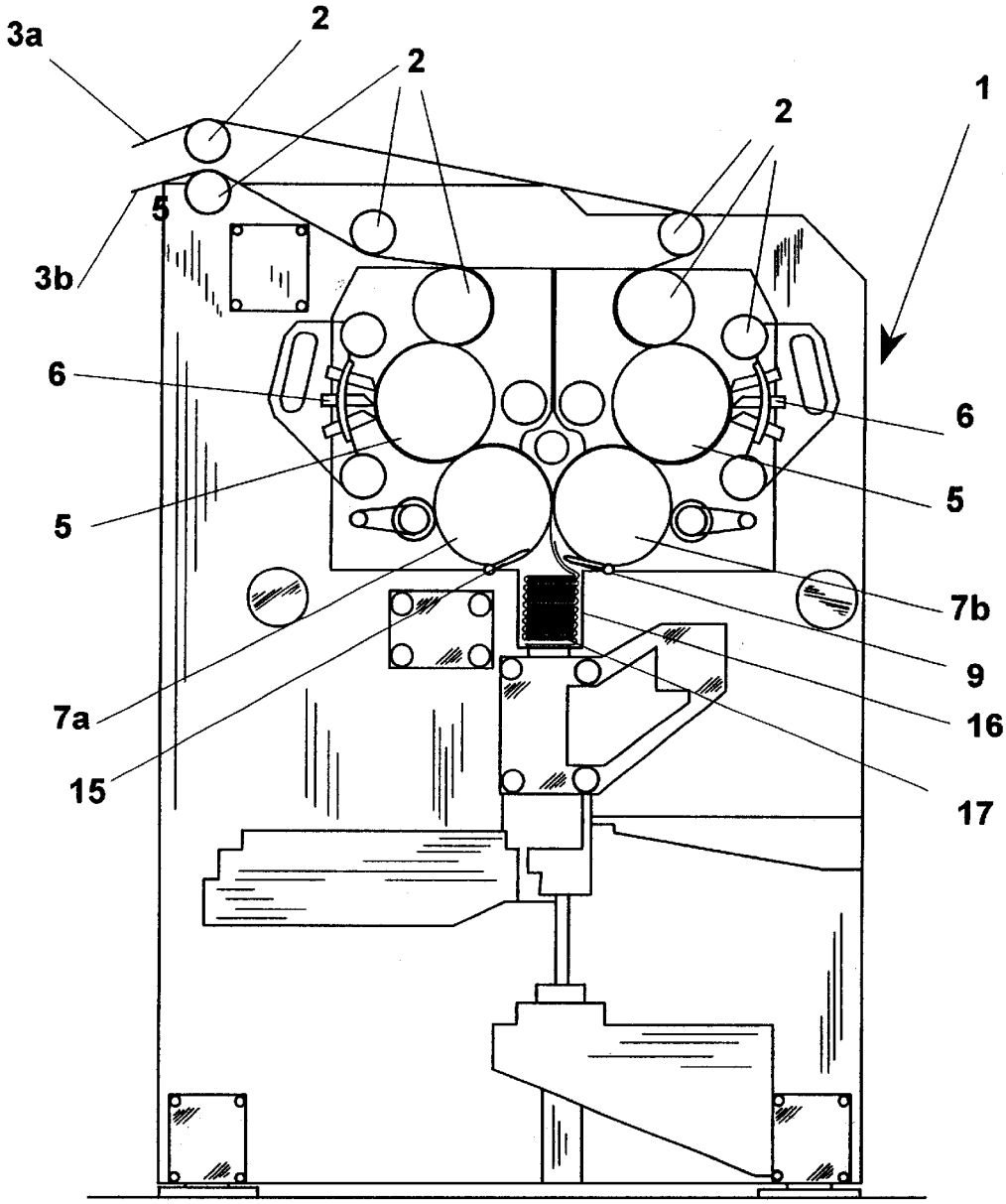
FIG. 1 shows a cross sectional view of a machine used to carry out the interfolding method of sheet material according to the present invention.
Figure 8:
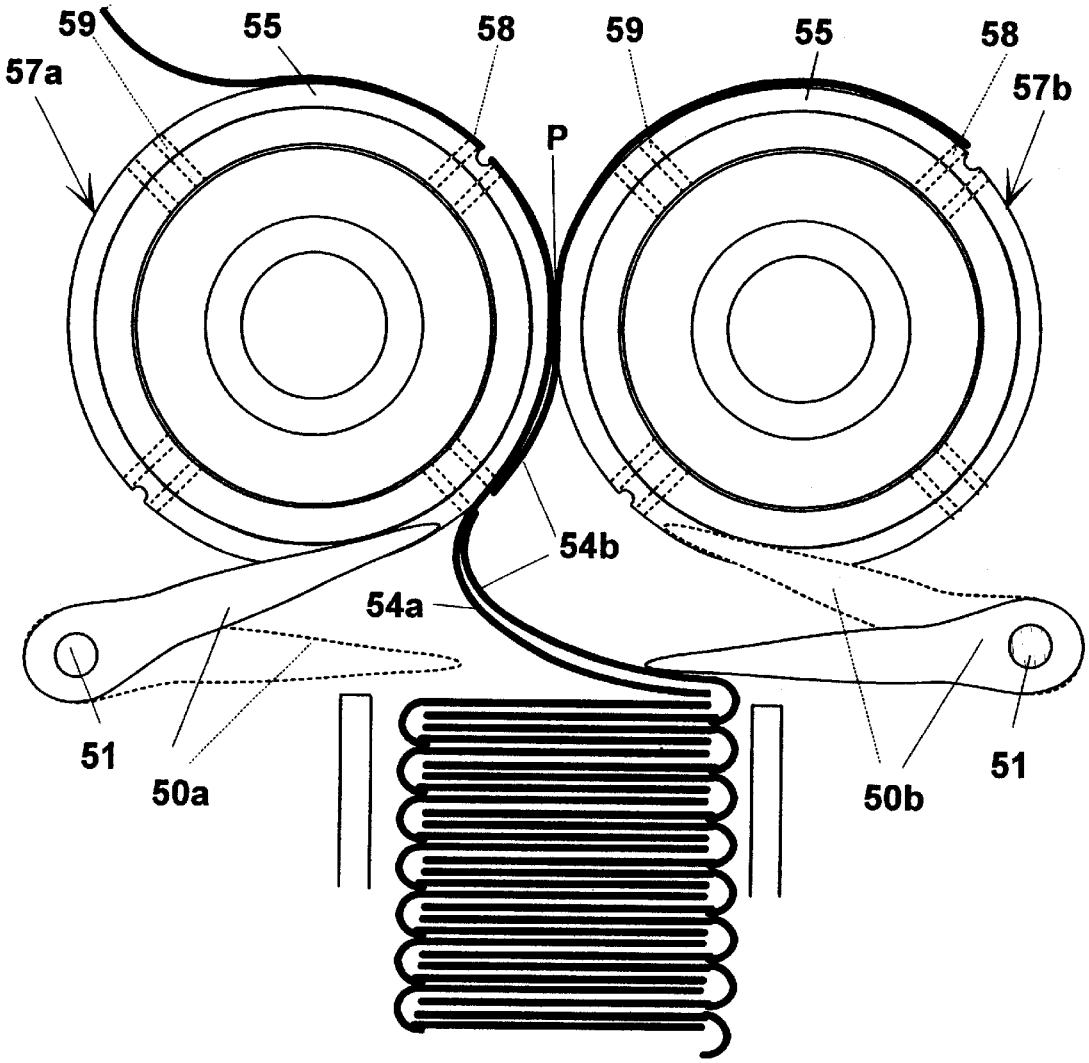
FIG. 8 shows folding rollers and relative folding arms of an interfolding machine according to the prior art.

With reference to FIG. 1, a machine 1 for carrying out the method according to the invention for interfolding sheet material comprises deviation rollers 2 for supplying and stretching a web 3*a* coming from a first reel and a web 3*b* coming from a second reel.

The two webs 3*a* and 3*b* are supplied to cutting rollers 5 by which they are cut on blades 6 and they then form a sequence of offset sheets 4*a* and 4*b*. This sequence is such that two portions of the sheets 4*a* obtained from the first web 3*a* overlap a portion of a sheet 4*b* obtained from the second web 3*b*, and vice versa.

The sheets 4*a* and 4*b* come to folding rollers 7*a* and 7*b* comprising (FIG. 2) first sucking spots 8*a* and 8*b*, in three rows angularly spaced 120° from one another and second sucking spots 9*a* and 9*b* also in three rows angularly spaced 120° from one another.

Folding rollers 7*a* and 7*b* are counter-rotating with respect to each other and their point of contact is indicated as P. Sucking spots 8*a* and 9*a* of roller 7*a* respectively coincide at point P with sucking spots 9*b* and 8*b* respectively, of roller 7*b*. Folding rollers 7*a* and 7*b* have external circumferences three times the length of the sheets 4*a* and 4*b*, respectively and the latter have beginnings and ends at the sucking spots 8*a* and 8*b*, respectively, where a groove is provided (FIG. 2) to prevent the blade of the roller 5 from hitting against rollers 7*a* and 7*b*.

The vacuum at sucking spots 8*a*, 8*b* and 9*a*, 9*b* is created only at certain angles of the rotation of rollers 7*a* and 7*b*. More precisely, spots 8*a* and 8*b* suck the sheets 4*a* and 4*b* upstream of point P, whereas spots 9*a* and 9*b* suck the sheets 4*a* and 4*b* downstream of point P. In other words, the sucking spots 8*a* and 8*b* have the task of dragging sheets 4*a* and 4*b* still separated up to the point P of contact between the two folding rollers respectively 7*a* and 7*b*. Whilst continuing the rotation, after point P, sucking spots 8*a* and 8*b* stop sucking and one of the two sheets, 4*a* or 4*b*, passes to the other roller, 7*b* or 7*a*, respectively through sucking spots 9*a* and 9*b* that have started sucking just after point P.

The start or the end of the sucking steps is obtained by means of fixed channels and vacuum delivery valves, not shown because known in the art and therefore obvious for a skilled man, arranged inside folding rollers 7*a* and 7*b*.

Sucking spots 8*a*, 8*b* and 9*a*, 9*b* are arranged on the periphery of rollers 7*a*, 7*b*, on a plurality of circumferential rings, which are alternate to a plurality of circumferential grooves 15*a* and 15*b* wherein folding arms 20*a* and 20*b* engage having the task of folding the sheets 4*a* and 4*b* that are delivered partially overlapping each other by rollers 7*a* and 7*b*.

For example, in FIG. 3 a sheet 4*b* which is facing point P and a sheet 4*a*' that is leaving point P followed by a sheet 4*a*" are shown. Sheet 4*b* has a downstream portion that has passed point P and an upstream portion that adheres to roller 7*b*. At the other side, the downstream portion of sheet 4*a*' is held by sucking spots 8*a* and pulled up to point P. Here sucking spots 9*b* are activated and, by sucking through the web of paper, cause the upstream portion of sheet 4*a*' and the downstream portion of sheet 4*a*" to leave roller 7*a* pulling it along with sheet 4*b* until they cover folding arms 20*a* and 20*b*.

This way the overlapping step is carried out of the two sheets 4*a* and 4*b* that are then pushed between guides 16 on interfolded stack 17 shown below in FIG. 2.

According to the present invention, folding arms 20*a* and 20*b* have a pivot of rotation 21 very close to the periphery of folding rollers 7*a* and 7*b*. In FIG. 2, for example, the pivot of rotation 21 is inside grooves 15*a* and 15*b*. In this way, the rotation of the folding arms 20*a* and 20*b* beyond pivot 21 causes:

- each folding arm to go into groove 15*a* or 15*b*, as shown in FIG. 2 with folding arm 20*b* indicated with continuous line,
- each folding arm to go out groove 15*a* or 15*b* after a rotation about pivot 21 up to becoming parallel to stack 17 of interfolded sheets and to fold sheet 4*a*' and the downstream portion of sheet 4*b*, as shown in FIG. 2 for folding arm 20*a* indicated with continuous line.

With reference to FIG. 4, in a different embodiment with respect to that of FIG. 2, folding arms 30*a* and 30*b* are curved so that they go completely into grooves 15*a* and 15*b*. Moreover, being their shape curved, a portion of the folding arms can encircle a portion of roller 7*a* or 7*b* as well as it can move to a position tangent to the stack being formed 17 (shown in FIG. 2). Moreover, rollers 7*a* and 7*b* can have shallow grooves 15*a* and 15*b*.

Also in this case, pivot 21 is located inside grooves 15*a* or 15*b*. This allows that folding arms 30*a* and 30*b* are short enough and at the same time can become parallel to the stack 17 being formed so that the folding step is carried out correctly.

In the embodiment of FIGS. 4 and 5 the movement of the folding arms 30*a* and 30*b* is a movement composite obtained through two distinct points 31 and 32 of the folding arms in a same plane. In particular, first point 31 is the pivot of rotation laying inside grooves 15*a* or 15*b*, and second point 32 rotates about the first point by means of a connecting rod 33 pivotally connected to the folding arms in 32 and to a oscillating crank 34 about axis 35 by means of a not shown drive. The pivot 31 is arranged on a fixed arm 36 that keeps it still between grooves 15a and 15*b*.

This embodiment allows to make folding arms 30*a* and 30*b* short enough also in case of folding rollers 7*a* and 7*b* of diameter larger than in the prior art, and the rotation about pivot 31 is particularly effective for the folding step. Moreover, the mechanical transmission can be easily adapted to folding rollers of larger or shorter diameter replacing the connecting rod 33 and displacing pivot 31. Notwithstanding folding arms 30*a* and 30*b* can lay almost completely inside grooves 15*a* and 15*b*, these are shallow owing to the movement possible by means of the mechanical transmission above described and to their bent shape.

With reference to FIGS. 6 and 7, in a further different embodiment with respect to FIG. 2, folding arms 40*a* and 40*b* are broadly curved so that they go completely into shallow grooves 15*a* and 15*b*.

In this case, the folding arms can encircle a portion larger of roller 7*a* or 7*b* and the folding step is carried out by the curved shape which guides like a shroud the stack 17 being formed (shown in FIG. 2). Pivot 41 is located very close to the folding rollers 7*a* and 7*b* but just outside grooves 15*a* or 15*b*.

Also in this case folding arms 40*a* and 40*b* have a composite movement obtained through two distinct axes 41 and 42 thereof in a same plane. In particular, first axis 41 is the pivot belonging to a connecting lever 43 integral to the folding arms 40*a* and 40*b*. The second axis 42, always of connecting lever 43, rotates about pivot 41 by means of a rocking lever 44 pivotally connected to connecting lever 43 on the other side with respect to pivot 41. A cam 45 is provided continuously rotating about axis 46 by means of a not shown drive. The cam engages against a pin 47 integral to rocking lever 44. Pivot 41 is arranged on a support not shown.

This embodiment has the advantage of requiring grooves 15*a* and 15*b* shallower than in the previous case.

Notwithstanding reference has been made to sheets cut by means of cutting roller 5 and blades 6, it is also possible that the sheets are obtained by means of tearing a continuous web with transversal perforations.

Moreover, the sheets can be obtained starting from a web unwound from a single reel instead of two or more reels.

Notwithstanding, finally, in the description and in the drawings reference has been made to the case of L interfolding, it is clear that the concepts above described are adaptable without difficulty to the case of W or Z interfolding, in a way obvious for a person skilled in the art.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for production of a stack of interfolded sheets comprising the steps of:

feeding of sheets in succession on folding rollers that comprise means for selectively holding the sheets on their surface so that a sequence of offset sheets is created;

alternately holding the sheets by means of folding rollers downstream of their point of contact in order to obtain an interfolded disposition; and, folding and formation of said stack of interfolded sheets by the use of folding arms each pivoting about a pivot which is located within a respective groove formed within the periphery of each of said folding rollers and pushing away alternatively the partially overlapped portions of sheets in succession that adhere to said rollers onto a stack formed below.

2. The method according to claim 1, wherein said folding arms have a curved shape so that they encircle a portion of said folding rollers.

3. The method according to claim 1, wherein said folding arms carry out an oscillation obtained through two distinct points thereof in a same plane, a first of said points being a pivot, a second point rotating about said first point.

4. The method according to claim 3, wherein said first pivot is located at a distance from an axis of rotation of each of said folding rollers which is slightly greater than a radius of each of said folding rollers.

5. The method according to claim 3, wherein said first point lays proximate the periphery of the folding roller inside said grooves.

6. An interfolding machine using sheet material for formation of stacks of interfolded sheets comprising:

folding rollers counter-rotating with respect to each other supplied of sheets in succession and having circumferential grooves;

means for holding alternatively the sheets that adhere to the folding rollers; and, interfolding means suitable for the formation of a stack of sheets comprising folding arms oscillating about a pivot and going into and out said grooves of said rollers, wherein said folding arms are pivotally connected to a pivot very close to the periphery of said folding rollers, wherein said pivot is inside the periphery of said folding rollers.

7. The interfolding machine according to claim 6, wherein a mechanical transmission operating said folding arms is provided comprising:

a pivot to which each folding arm is pivotally connected in a first point;

a connecting rod hinged to the folding arm in a second point; and, an oscillating crank lever hinged to said connecting rod.

8. The interfolding machine according to claim 6, wherein said folding arms have a circular portion so that they encircle a portion of said rollers.

9. The interfolding machine according to claim 6, wherein said mechanical transmission operating said folding arms comprises:

a pivot belonging to a connecting lever integral to the folding arms;

a rocking lever hinged to said connecting lever; and, cam means that engage with a pin protruding from said rocking lever whereby said rocking lever carries out an alternating motion that causes said connecting lever and said folding arms to oscillate about said pivot.

10. The interfolding machine according to claim 6, wherein said folding arms have a circular portion, so that they encircle a portion of said rollers.

11. The interfolding machine according to claim 6, wherein a mechanical transmission operating said folding arms is provided comprising:

a pivot to which each folding arm is pivotally connected in a first point;

a connecting rod hinged to the folding arm in a second point, an oscillating crank lever hinged to said connecting rod.

12. The interfolding machine according to claim 6, wherein said mechanical transmission operating said folding arms comprises:

a pivot belonging to a connecting lever integral to the folding arms;

a rocking lever hinged to said connecting lever;

cam means that engage with a pin protruding from said rocking lever whereby said rocking lever carries out an alternating motion that causes said connecting lever and said folding arms to oscillate about said pivot.

13. An interfolding machine for making stacks of interfolded sheets comprising:

a first folding roller arranged for rotation in a first direction about a first axis through which a first vertical plane passes;

a second folding roller arranged for rotation in a second direction counter to said first direction about a second axis through which a second vertical plane passes;

each of said first and second folding rollers operatively arranged to receive sheets of material in succession and to hold said received sheets against said first and second folding rollers;

means for holding alternatively the sheets which adhere to the folding rollers; and, interfolding means operatively arranged to form a stack of sheets, said interfolding means comprising first and second folding arms, each of which oscillates about a first and second pivot, respectively, and arranged for movement into and out of grooves in each of said rollers, said stack being formed in a space located between said first and second vertical planes, wherein the first and second pivots are positioned between said first and second vertical planes.

14. An interfolding machine for making stacks of interfolded sheets comprising:

a first folding roller arranged for rotation in a first direction about a first axis through which a first vertical plane passes;

a second folding roller arranged for rotation in a second direction counter to said first direction about a second axis through which a second vertical plane passes;

each of said first and second folding rollers operatively arranged to receive sheets of material in succession and to hold said received sheets against said first and second folding rollers;

means for holding alternatively the sheets which adhere to the folding rollers; and, interfolding means operatively arranged to form a stack of sheets, said interfolding means comprising first and second folding arms, each of which oscillates about a first and second pivot, respectively, and arranged for movement into and out of grooves in each of said rollers, said stack being formed in a space located between said first and second vertical planes, wherein the first and second pivots are positioned between said first and second vertical planes, wherein said folding arms are curved at an angle of curvature that matches a circumference of said grooves.

* * * * *